United States Patent [19]

Maier

[11] Patent Number: 5,039,158

[45] Date of Patent: Aug. 13, 1991

[54] SEATING CUSHION

[76] Inventor: Edmund Maier, 76 Woodside Dr., Penfield, N.Y. 14625

[21] Appl. No.: 495,424

[22] Filed: Mar. 15, 1990

[51] Int. Cl.[5] ..... A47C 7/40

[52] U.S. Cl. ..... 297/460; 297/284

[58] Field of Search ..... 297/232, DIG. 1, 284, 297/219, 230, 452, 460, 231; 5/431, 432, 446, 464

[56] References Cited

U.S. PATENT DOCUMENTS

| | | | |
|---|---|---|---|
| 2,822,033 | 2/1958 | Dixon | 297/231 |
| 3,394,414 | 7/1968 | Unger | 297/452 |
| 3,885,258 | 5/1975 | Regan | 297/452 |
| 4,471,993 | 9/1984 | Watson | 297/284 |
| 4,522,447 | 6/1985 | Snyder et al. | 297/DIG. 1 |
| 4,646,374 | 3/1987 | Shafer | 5/431 |
| 4,682,818 | 7/1987 | Morell | 297/452 |
| 4,835,801 | 6/1989 | Walpin et al. | 297/DIG. 1 |

FOREIGN PATENT DOCUMENTS

| | | | |
|---|---|---|---|
| 2117235 | 10/1983 | United Kingdom | 297/460 |

*Primary Examiner*—Kenneth J. Dorner
*Assistant Examiner*—Milton Nelson, Jr.
*Attorney, Agent, or Firm*—Howard J. Greenwald

[57] ABSTRACT

An integral, lower back support cushion which is comprised of at least three layers of resilient material with different physical properities. At least one of the layers of the device contains at least three segments of resilient material, at least two of which have different physical properties, and at least two such segments have substantially identical physical properties. Both of the front and back layers of the device have convex shapes.

7 Claims, 6 Drawing Sheets

SEATING CUSHION

FIELD OF THE INVENTION

A lower back support cushion containing at least three layers of resilient material, at least one of which is segmented.

BACKGROUND OF THE INVENTION

Devices for supporting the lumbar region of the back are well known to those skilled in the art. Thus, for example, U.S. Pat. No. 4,597,386 of Goldstein describes a cushion comprising a plurality of juxtaposed segments retained in mutually supporting engagement with each other by a cover. The device of this patent, however, is not integral and, thus, cannot be used without its cover. Furthermore, such device, because its has substantially uniform stiffness properties in the lateral direction, does not provided adequate cushioning locally for the bony protuberances of the spinal column.

U.S. Pat. No. 4,161,337 of Ross et al. provides a portable orthopedic seat unit insert which is comprised of two separate, spaced-apart, padded, generally elliptical back support members, and a substantially vertically rigid conecting member joining them together. However, the vertically rigid connecting member of this patent does not provide any support at all for the spinal column.

U.S. Pat. No. 3,856,349 of Light discloses (at column 1) that, "... during prolonged sitting the lower back, at rest, gradually assumes the curvature of the material it is resting against, and, if this is a cushion or a curved seat back, the person's natural lordosis is accentuated." The device of this patent is comprised of a substantially flat and elongated pad which is relatively rigid throughout the complete length thereof. However, the device of this patent does not provide adequate cushioning to lumbar region of the back and, furthermore, artificially constrains the back into an unnatural and uncomfortable position.

U.S. Pat. No. 4,471,993 of Watson describes a device for supporting the low back area of the body comprising a front resilient member and an inner core. The device of this patent, because its has substantially uniform stiffness properties in the lateral direction, does not provided adequate cushioning locally for the bony protuberances of the spinal column. Furthermore, because of the dimensions and the configuration of the device of this patent, one using it is pushed forward in the seat and thus cannot utilize all of the support afforded by the entire length of the seat bottom with most conventional chairs.

It is an object of this invention to provide a lower back support cushion which, when in place on the back of a seating surface or device, provides support to the curvature of the lower back while simultaneously alleviating local pressure on the bony protuberances of the spinal column.

It is another object of this invention to provide lower-back support cushion with arcuate curvature so adapted, when it is used by a patient, will allow him to utilze substantially all of the support afforded by the length of the seat bottom.

It is another object of this invention to provide an integral, multi-layered cushion which may be used without a cover.

It is yet another object of this invention to provide a means for removably and adjustably attaching the back cushion of this invention to a seating device.

It is yet another object of this invention to provide a back cushion whose use tends to insure correct lateral placement of the spinal column in the lower back region.

SUMMARY OF THE INVENTION

In accordance with this invention, there is provided an integral, lower back support cushion which is comprised of at least three layers of resilient material with different physical properites. At least one of the layers of the device contains at least three segments of resilient material, at least two of which have different physical properties, and at least two which have substantially identical physical properties. The back layer of the device has a convex shape.

DESCRIPTION OF THE DRAWINGS

The present invention will be more fully understood by reference to the following detailed description thereof, when read in conjunction with the attached drawings, wherein like reference numerals refer to like elements and wherein.

DESCRIPTION OF THE PREFERRED EMBODIMENTS

Figure 1:
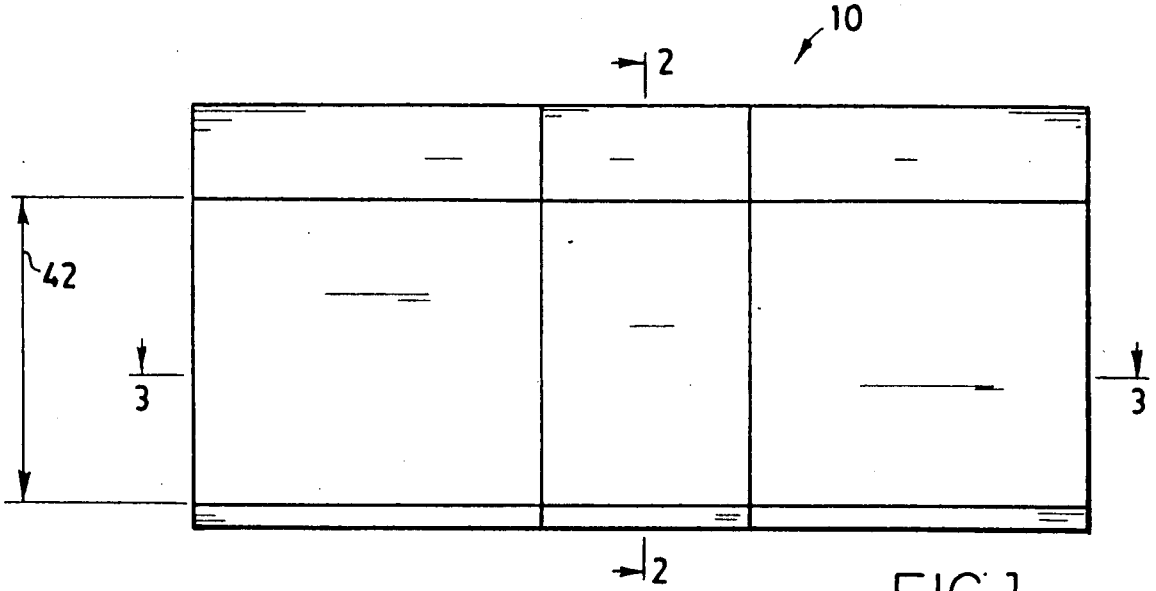
FIG. 1 is a front sectional view of one preferred embodiment of the cushion of this invention.

Referring to FIG. 1, a front phantom view of one of the preferred embodiments of the lower back cushion 10 of this invention is shown.

Figure 2:
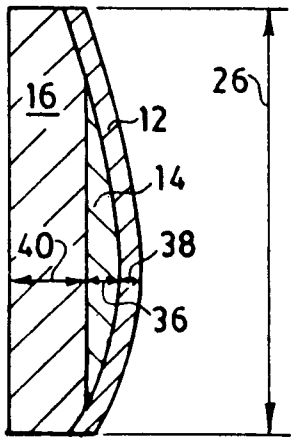
FIG. 2 is a side sectional view of one preferred embodiment of the cushion of this invention.

FIG. 2 is a side sectional view of the embodiment of FIG. 1, taken along line 2—2. Referring to FIG. 2, cushion 10 is multi-layered, being comprised of front layer 12, intermediate layer 14, and back layer 16.

The cushion 10 of this invention, as is shown in FIG. 2, is preferably comprised of at least three foam materials, at least two of which have different physical properties. In one embodiment, the cushion is comprised of at least three foam materials which have different physical properties.

The term foam, as used in this specification, refers to a material with a spongelike, cellular structure and includes materials such as, e.g., polyurethane foam, foam rubber, flexible foamed thermoplastic elastomers, and the like. Reference may be had, e.g., to George S. Brady et al.'s "Materials Handbook," Twelfth Edition (McGraw-Hill Book Company, Inc., New York, 1986), the disclosure of which is hereby incorporated by reference into this specification.

In one preferred embodiment, each of the layers 12, 14, and 16 consist essentially of different types of foam such as, e.g., polyurethane foam. As is known to those skilled in the art, urethanes are a group of plastic materials based on polyether or polyester resin; see, e.g., pages 848–849 of said Brady et al. book.

Thus, for example, one may use polyurethane foams obtainable from the Recticel Foam Corporation of Leroy, N.Y. As is known to those skilled in the art, these urethane foams often are made with various isocyanates such as, e.g., toluene diisocyanate (TDI) and/or 4,4'-diphenylmethane diisocyanate (MDI) reacting with linear polyols of the polyester and polyether families.

It is preferred that layer 12 consist essentially of polyurethane foam which has a density of at least 1.25 pounds per cubic foot and an indention load deflection (ILD) of at least about 40 pounds. Thus, for example, one may use Recticel polyurethane foams GC170070N, GY170070C, and mixtures thereof for layer 12; these foams are substantially identical to each other, with the exception that the latter one is flame-retardant and the former is not. Each of these foams has a density of at least about 1.7 pounds per cubic foot and an ILD of at least about 70 pounds.

It is preferred that layer 14 consist essentially of polyurethane foam which has a density of at least 1.25 pounds per cubic foot and an indention load deflection (ILD) of at least about 30 pounds.

Layer 16 of cushion 10 preferably contains at least three segments of resilient material (such as, e.g., polyurethane foam), at least two of which have different physical properties, and at least two of which preferably have substantially identical physical properties. Referring to the preferred embodiment illustrated in FIG. 3, it will be seen that, in this embodiment, layer 16 is comprised of segments 18, 20, and 22. In this embodiment, segments 18 and 22 are identical to each other but differ from segment 20; segments 18 and 22 differ from each of layers 12 and 14; segment 20 differs from layer 12 and may—but need not—be different than layer 14.

It is preferred that segments 18 and 22 of layer 16 consist essentially of polyurethane foam which has a density of at least 1.25 pounds per cubic foot and an indention load deflection (ILD) of at least about 70 pounds. Thus, for example, one may use Recticel polyurethane foams GP220125N for these segments. This foam has a density of at least about 2.15 pounds per cubic foot and an ILD of at least about 125 pounds.

Segment 20 of layer 16 may be identical to or different from layer 14. It is preferred, however, that segment 20 consist essentially of polyurethane foam which has a density of at least 1.25 pounds per cubic foot and an indention load deflection (ILD) of at least about 30 pounds.

The physical properties of the polyurethane foam may be determined in accordance with A.S.T.M. Standard Test D-3574-81, the disclosure of which is hereby incorporated by reference into this specification.

Cushion 10 may be fabricated by means well known to those skilled in the art. Thus, for example, each of layers 12 and 14 and segments 18, 20, and 22 may be joined together by conventional means to produce cushion 10. Thus, e.g., such joining may be effected by contact or other adhesives, sonic welding, and the like. It is preferred to join the segments and layers by adhesives. Any of the adhesives well known to those skilled in the art may be used; see, e.g., pages 81–86 of Volume 1 of the McGraw-Hill Encyclopedia of Science and Technology (McGraw-Hill Book Company, New York, 1977), the disclosure of which is hereby incorporated by reference into this specification.

In one embodiment, cushion 10 is produced by a molding process in which segments 18 and 22 are prefabricated, placed into a mold, and layers 12 and 14 and segment 20 are formed in situ by injecting the reactants for each material in contact with each other (but separated from the reactants for other materials) into the mold in a specified sequence.

The stiffness properties of the preferred resilient materials used in applicant's cushion 10 are defined by the indention load (force) deflection, which, as indicated above, may be determined for any particular layer or segment of material in accordance with A.S.T.M. Standard Test D-3574-81. The layers and segments of the cushion of this invention have ILD properties such that specified ratios of ILD ratings are present.

Each of segments 18 and 22 preferably have an ILD rating of from about 70 to about 150 pounds and, more preferably, from about 100 to about 130 pounds. The ILD rating of the resilient material of each of segments 18 and 22 is from about 2.0 to about 4.0 times as great as the ILD rating of segment 20. In one preferred embodiment, the ILD rating of the resilient material of each of segments 18 and 22 is from about 2.7 to about 2.9.

Segment 20 has an ILD rating of from about 30 to about 70 pounds. It is preferred that segment 20 have an ILD rating of from about 40 to about 50 pounds.

Layer 14 may consist essentially of the same material which is present in segment 20, or of different material. Layer 14 also has an ILD rating of from about 30 to about 70 pounds. The material in layer 14 has an ILD rating which is from about 1.0 to about 1.5 times as great as the ILD rating of segment 20. Furthermore, the material in layer 14 has an ILD rating which is from about 0.5 to about 1.0 times as great as the ILD rating of the material in layer 12.

Layer 12 preferably has an ILD rating of from about 40 to about 100 pounds and, preferably, from about 65 to about 85 pounds.

The cushion 10 of this invention must have specified dimensions in order for it to have the desired properties. Thus, referring to FIG. 3, cushion 10 has a width 24 of from about 7.0 to about 14.0 inches and, preferably, from about 10.0 to about 13.0 inches. In one preferred embodiment, width 24 is 12.5 inches.

Referring to FIG. 2, cushion 10 has a height 26 of from about 3.0 to about 12.0 inches and, preferably, from about 4.5 to about 6.0 inches. In one preferred embodiment, height 26 is about 5.5 inches.

Referring again to FIG. 3, cushion 10 has a thickness 28 of from about 0.5 to about 5.0 inches and, preferably, from about 1.5 to about 2.0 inches. In one preferred embodiment, thickness 28 is about 1.75 inches.

Center segment 20 of layer 16 must have a width 30 of from about 1.5 to about 5.0 inches and, preferably, from about 2.0 to about 4.0 inches. Each of segments 18 and 22 have widths, which may be the same or different, of from about 2.0 and 7.0 inches.

At least segments 18 and 22 of layer 16 are curved so that the rear surface of layer 16 defines a generally convex shape. The arc 32 of segment 18, and the arc 34 of segment 22, are both defined by a radius which is from about 3.0 inches to about 24.0 inches and, preferably, from about 10.0 to about 14.0 inches. In one preferred embodiment, the radii of arcs 32 and 34 are from about 12 to about 12.5 inches.

The maximum thickness 36 of layer 14 (see FIG. 3) should preferably be from about 1.0 to about 2.0 times as great as the thickness 38 of layer 12 and from about 0.25 to about 1.0 times as great as the maximum thickenss 40 (see FIG. 2) of layer 16. However, layer 14 has a height 42 (see Figure) which must always be either less than or equal to the height of layer 16.

Figure 3:
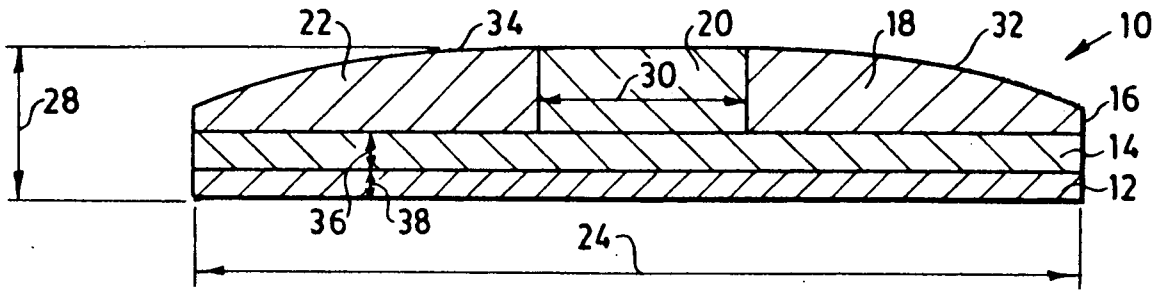
FIG. 3 is a top sectional view of one preferred embodiment of the cushion of this invention.

Referring to FIG. 3, it will be seen that the front surface of layer 14 describes an arcuate shape whose maximum height 42 is less than the height of layer 12.

Figure 4:
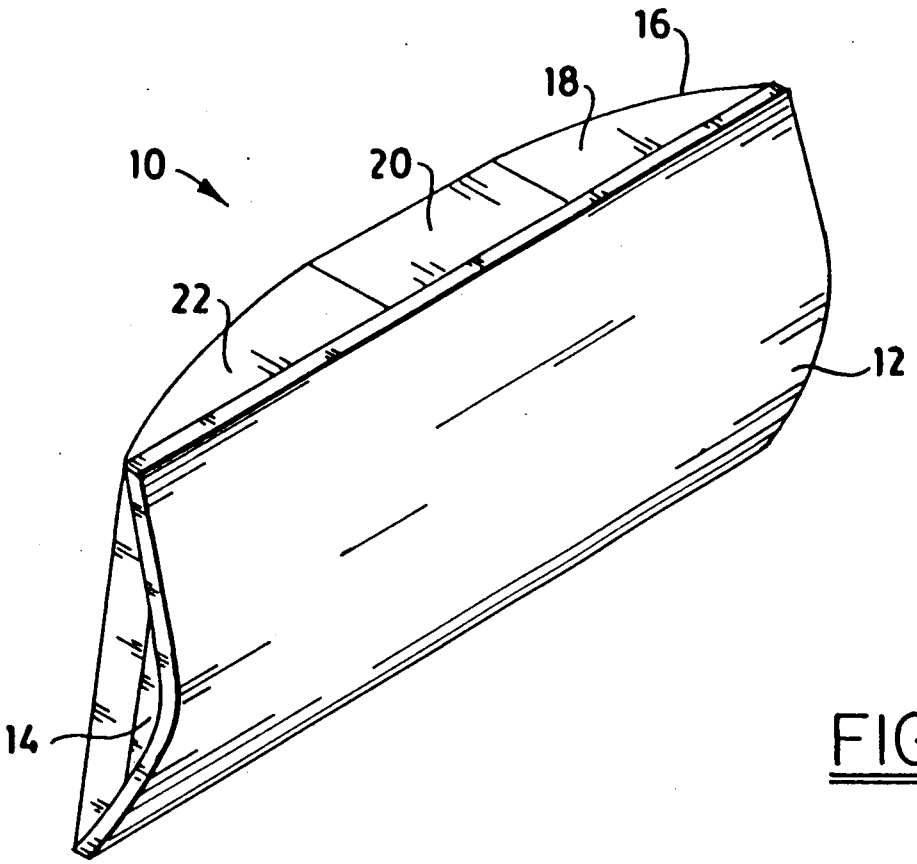
FIG. 4 is a perspective view of the preferred embodiment of FIG. 1.

FIG. 4 is a perspective view of the cushion 10. It will be noticed that, in the preferred embodiment of this Figure, layer 12 defines an arcuate shape.

Figure 6:
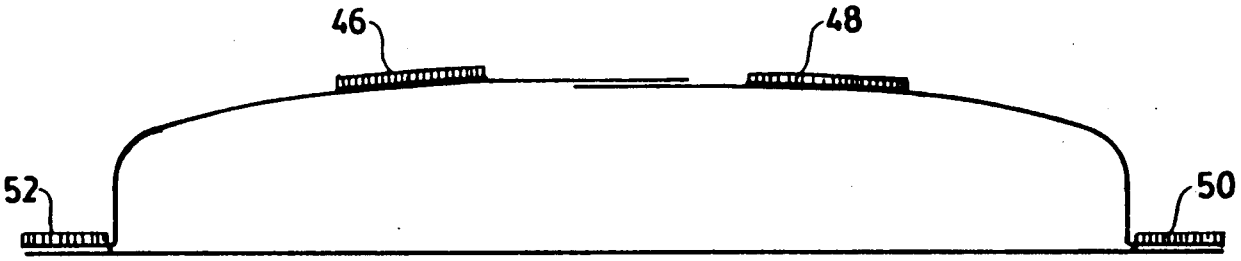
FIGS. 5, 6, and 7 illustrate back, top, and side views, respectively, of a cover used in one preferred embodiment of this invention.
Figure 5:
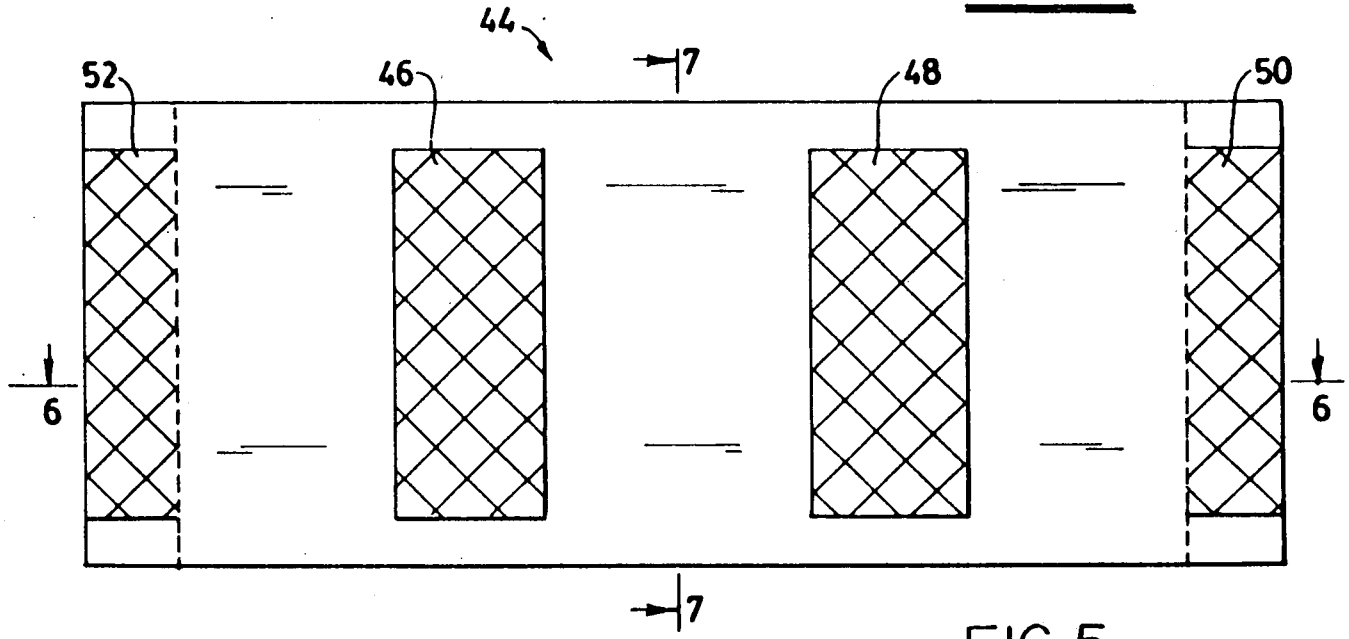
Figure 7:
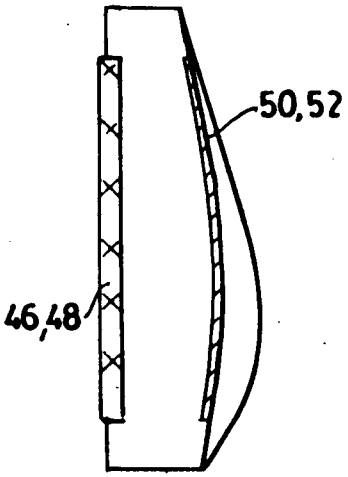

FIG. 5 illustrates a cover 44 which may be used to cover and encapsulate cushion 10; also see FIGS. 6 and 7, which are sectional views taken along lines 6—6 and 7—7, respectively. This cover 44 contains "VELCRO" attachment means 46, 48, 52, and 54. As those skilled in the art are aware, "VELCRO" refers to synthetic materials which adhere when pressed together.

Figure 8:
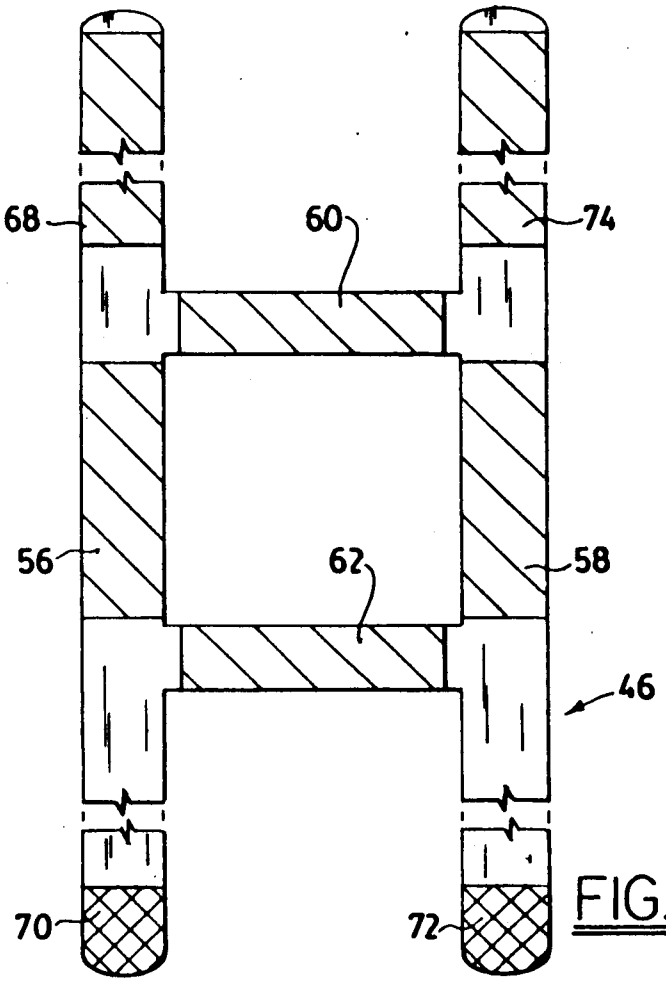
FIGS. 8 and 9 illustrate means for attaching the cushion of this invention to a chair.

FIG. 8 illustrates a harness 46. This harness 46 is comprised of "VELCRO" material attached at points 56, 58, 60, and 62. The "VELCRO" on the harness 46 is complementary to the "VELCRO" on cover 44 and allows the removable attachment of the cover 44 to harness 46.

Figure 9:
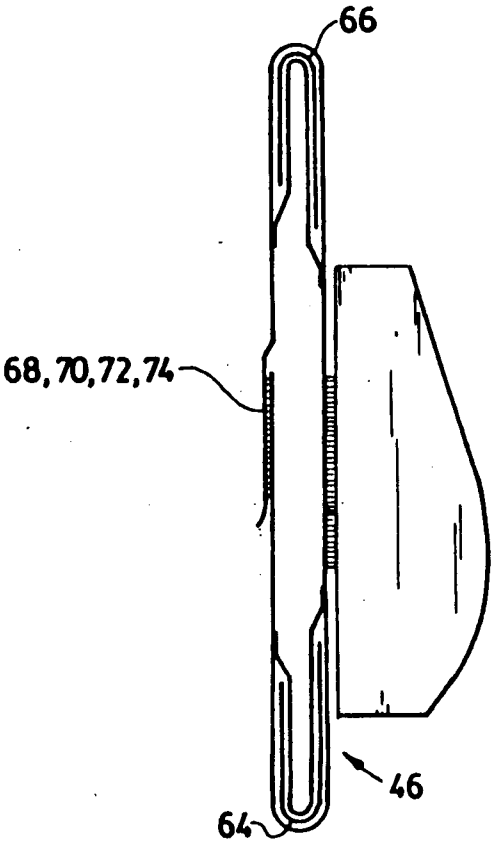

Referring to FIG. 9, harness 46 may be removably attached to a chair (not shown) by conventional means. Thus, referring to FIG. 9, one may use hooks 64 and 66 to attach the harness 46 to the chair. In one embodiment, curved hooks 64 and 66 are formed from bendable metal segments covered by the fabric of harness 44, and they are preferably embedded in harness 44. Additionally, or alternatively, one may also tighten harness 46 around the chair by "VELCRO" means 68, 70, 72, and 74.

Figure 10:
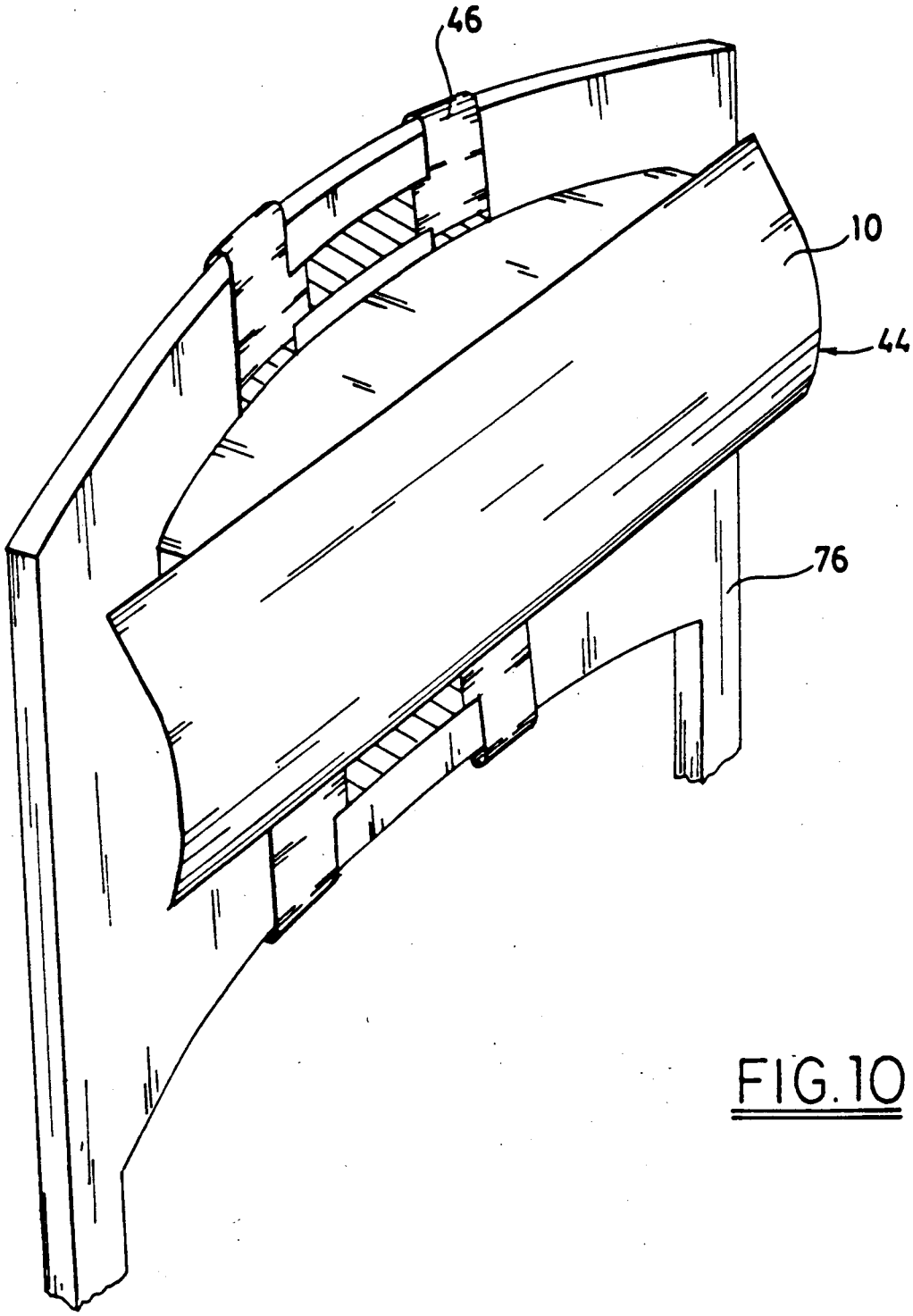
FIGS. 10 and 11 illustrate a covered cushion within the scope of this invention attached to a chair with the attachment means of FIGS. 8 and 9.
Figure 11:
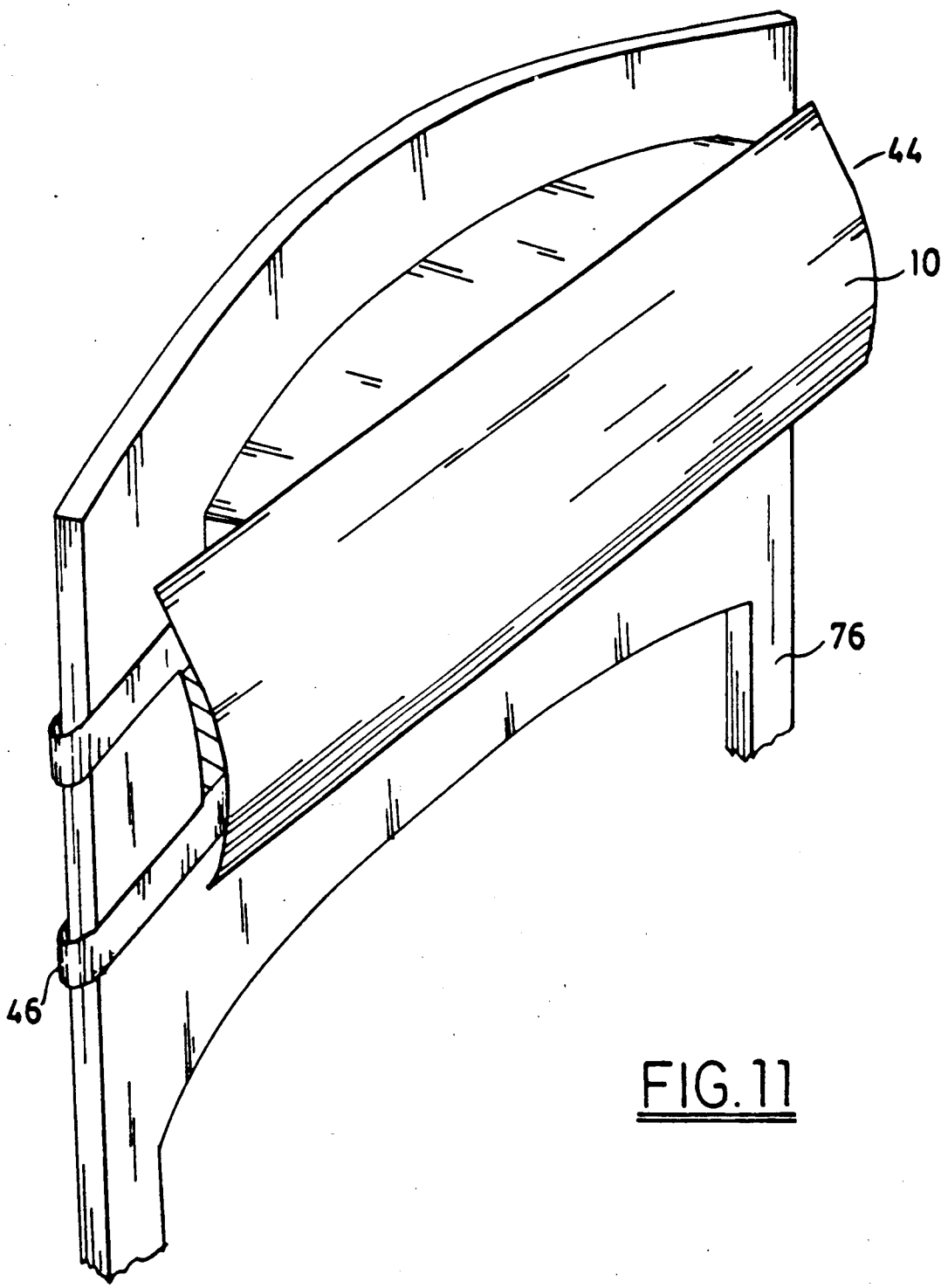

FIGS. 10 and 11 illustrate covered cushion 10 in place on a chair 76, secured by means of harness 46.

It is to be understood that the aforementioned description is illustrative only and that changes can be made in the apparatus, the ingredients and their proportions, and in the sequence of combinations and process steps as well as in other aspects of the invention discussed herein without departing from the scope of the invention as defined in the following claims.

I claim:

1. A non-rectilinear, integral lower back support cushion which consists essentially of resilient material and which is comprised of at least a front layer and a middle layer defining a curved front surface of said cushion, and a rear layer defining a curved rear surface of said cushion, wherein:

(a)at least two of said front, middle, and rear layers have different physical properties;

(b)said rear layer is comprised of at least a first end segment, a center segment, and a second end segment, wherein:

1. each of said first end segment and said second end segment have an indention load deflection of from 70 to 150 pounds;
2. said center segment has an indention load deflection of from 30 to 70 pounds;
3. the indention load deflection of each of said end segments is from 2.0 to 4.0 times as great as the indention load deflection of said center segment;

(c)said front layer has an indention load deflection of from 40 to 100 pounds;

(d) said middle layer has an indention load deflection of from 30 to 70 pounds, wherein:

1. the indention load deflection of said middle layer is from 1.0 to 1.5 times as great as the indention load deflection of said center segment, and
2. the indention load deflection of said middle layer is from 0.5 to 1.0 times as great as the indention load deflection of said front layer;

(e) said cushion has a width of from 7 to 14 inches, a height of from 3.0 to 12 inches, and a thickness of from 0.5 to 5.0 inches;

(f) said center segment has a width of from 1.5 to 5.0 inches; and (g) each of said end segments have widths of from 2 to 7 inches.

2. The cushion as recited in claim 1, wherein said resilient material is a foam material.

3. The cushion as recited in claim 2, wherein said foam material is selected from the group consisting of polyurethane foam, foam rubber, and flexible foamed thermoplastic elastomers.

4. The cushion as recited in claim 3, wherein said foam is polyurethane foam.

5. The cushion as recited in claim 4, wherein said polyurethane foam has a density of at least 1.25 pounds per cubic foot.

6. The cushion as recited in claim 1, wherein each of said first end segment and said second end segment are curved and define a convex rear surface across the width of said cushion.

7. The cushion as recited in claim 6, wherein said front layer and said middle layer define a convex front surface across the height of said cushion.

* * * * *